US009316184B2

(12) United States Patent
Tao et al.

(10) Patent No.: US 9,316,184 B2
(45) Date of Patent: Apr. 19, 2016

(54) ELECTRIC-FIELD ASSISTED FUEL ATOMIZATION SYSTEM AND METHODS OF USE

(75) Inventors: Rongjia Tao, Cherry Hill, NJ (US); Ke Huang, Philadelphia, PA (US); Deepika Khilnaney-Chhabria, Collegeville, PA (US); Edward Kaczanowicz, Woodstown, NJ (US)

(73) Assignee: Temple University of the Commonwealth System of Higher Education, Philadelphia, PA (US)

( * ) Notice: Subject to any disclaimer, the term of this patent is extended or adjusted under 35 U.S.C. 154(b) by 1264 days.

(21) Appl. No.: 12/513,019

(22) PCT Filed: Oct. 30, 2007

(86) PCT No.: PCT/US2007/022939

§ 371 (c)(1),
(2), (4) Date: Apr. 30, 2009

(87) PCT Pub. No.: WO2008/054753

PCT Pub. Date: May 8, 2008

(65) Prior Publication Data

US 2010/0024783 A1 Feb. 4, 2010

Related U.S. Application Data

(60) Provisional application No. 60/855,646, filed on Oct. 31, 2006.

(51) Int. Cl.

| | |
|---|---|
| ***F02M 27/00*** | (2006.01) |
| ***F02M 27/04*** | (2006.01) |
| *F02M 51/06* | (2006.01) |

(52) U.S. Cl.

CPC ..... *F02M 27/04* (2013.01); *F02M 51/061* (2013.01); *F23G 2202/701* (2013.01)

(58) Field of Classification Search

CPC . F02M 27/04; F02M 51/061; F23G 2202/701
USPC ..... 123/538, 549; 239/690
See application file for complete search history.

(56) References Cited

U.S. PATENT DOCUMENTS

| | | | |
|---|---|---|---|
| 1,552,034 | A | 9/1925 | Brown |
| 2,083,798 | A | 6/1937 | Roberts |

(Continued)

FOREIGN PATENT DOCUMENTS

| | | |
|---|---|---|
| CN | 1317639 | 10/2001 |
| CN | 2615351 | 5/2004 |

(Continued)

OTHER PUBLICATIONS

U.S. Appl. No. 11/792,553, filed Mar. 31, 2008, Tao et al.

(Continued)

*Primary Examiner* — Marguerite McMahon
*Assistant Examiner* — James Kim
(74) *Attorney, Agent, or Firm* — RatnerPrestia

(57) ABSTRACT

An apparatus (100) for reducing the size of fuel particles injected into a combustion chamber is disclosed. The apparatus includes fuel line (110), a first metallic mesh (114) disposed within the fuel line (110), and a second metallic mesh (112) disposed within the fuel line (110), upstream of the first metallic mesh (114). An electrical supply (130) is electrically coupled to the first metallic mesh (114) and the second metallic mesh (112). Operation of the electrical supply (130) generates an electrical field between the first metallic mesh (114) and the second metallic mesh (112). A fuel injector (120) is disposed at an end of the fuel line (110), downstream from the first metallic mesh (114). Methods of reducing the size of fuel particles, improving gas mileage in a vehicle, increasing power output from a combustion engine, and improving emissions for a combustion engine are also provided.

11 Claims, 4 Drawing Sheets

(56) References Cited

U.S. PATENT DOCUMENTS

| | | | | | |
|---|---|---|---|---|---|
| 2,083,799 | A | | 6/1937 | Roberts | |
| 3,304,251 | A | | 2/1967 | Walker | |
| 3,496,837 | A | | 2/1970 | McEuen | |
| 3,724,543 | A | | 4/1973 | Bell | |
| 3,880,192 | A | | 4/1975 | Denizov et al. | |
| 4,037,655 | A | | 7/1977 | Carpenter | |
| 4,150,647 | A | * | 4/1979 | Suzuki | F02D 35/00 123/438 |
| 4,203,398 | A | * | 5/1980 | Maruoka | F02D 41/18 123/538 |
| 4,204,923 | A | | 5/1980 | Carpenter | |
| 4,251,800 | A | * | 2/1981 | Sanner | G06K 9/228 235/472.01 |
| 4,254,800 | A | * | 3/1981 | Masaki | F15D 1/02 137/13 |
| 4,254,880 | A | | 3/1981 | Mangel | |
| 4,255,777 | A | | 3/1981 | Kelly | |
| 5,052,491 | A | | 10/1991 | Harms et al. | |
| 5,234,170 | A | | 8/1993 | Schirmer et al. | |
| 5,367,999 | A | * | 11/1994 | King et al. | 123/458 |
| 5,673,721 | A | | 10/1997 | Alcocer | |
| 5,843,301 | A | | 12/1998 | Esztergar | |
| 6,167,871 | B1 | | 1/2001 | Kumagai et al. | |
| 6,186,176 | B1 | | 2/2001 | Gelbmann | |
| 2003/0102123 | A1 | | 6/2003 | Wittle | |
| 2011/0030636 | A1 | * | 2/2011 | Detore | F02M 27/04 123/1 A |

FOREIGN PATENT DOCUMENTS

| | | |
|---|---|---|
| DE | 2850116 | 6/1979 |
| DE | 40 29 056 | 10/1991 |
| EP | 2078154 B1 | 4/2011 |
| JP | 5514471 | 1/1980 |
| JP | 5665160 | 6/1981 |
| JP | 07806 | 1/1995 |
| JP | 2004232585 | 8/2004 |
| KR | 100326607 | 2/2002 |
| RU | 2038506 | 6/1995 |
| RU | 2 083 915 | 4/1997 |
| RU | 2177112 | 12/2001 |
| RU | 2 196 919 | 1/2003 |

OTHER PUBLICATIONS

International Search Report for International Application No. PCT/US2005/44982 mailed Aug. 21, 2006.
International Search Report for International Application No. PCT/US2007/022939 mailed Apr. 29, 2008.
Written Opinion of the International Searching Authority for PCT/US2007/022939 mailed on May 14, 2009.
Office Action dated Oct. 26, 2009, U.S. Appl. No. 11/792,553, filed Mar. 31, 2008.
Office Action dated Feb. 10, 2009, U.S. Appl. No. 11/792,553, filed Mar. 31, 2008.
Office Action dated Oct. 14, 2008, U.S. Appl. No. 11/792,553, filed Mar. 31, 2008.
Examination Report in GB0711091.9 mailed Oct. 28, 2008.
International Search Report issued in PCT/US2005/44982 dated Aug. 21, 2006.
International Search Report issued in PCT/US2007/022939 mailed Apr. 29, 2008.
Office Action dated Feb. 28, 2012, application No. 2009120461/06(028274).
Canadian Office Action mailed May 2, 2012 in Canadian Application No. 2,668,157.
Chinese Office Action mailed Oct. 12, 2010 in Chinese Application No. 200780043825.X, including English language translation.
Chinese Office Action mailed Apr. 15, 2014 in Chinese Application No. 200780043825.X, including English language translation.
Japanese Office Action mailed Jul. 3, 2012 in Japanese Application No. 2009-534705, including English language translation.
Japanese Office Action mailed Mar. 5, 2013 in Japanese Application No. 2009-534705, including English language translation.
Korean Notice of Allowance mailed Jun. 19, 2013 for Korean Application No. 10-2009-7011159, including English language translation.
Korean Office Action mailed Jun. 21, 2012 for Korean Application No. 10-2009-7011159, including English language translation.
Korean Office Action mailed Feb. 22, 2013 for Korean Application No. 10-2009-7011159, including English language translation.
Russian Notice of Allowance mailed Jun. 18, 2012 for Russian Application No. 2009120461/06(028274), including English language translation.

* cited by examiner

ELECTRIC-FIELD ASSISTED FUEL ATOMIZATION SYSTEM AND METHODS OF USE

CROSS-REFERENCE TO RELATED APPLICATION

The present application is a National Stage Application of PCT Application No. PCT/US2007/022939, filed on Oct. 30, 2007, which claims priority from U.S. Provisional Patent Application Ser. No. 60/855,646, filed on Oct. 31, 2006, both of which are incorporated herein by reference in their entireties.

BACKGROUND OF THE INVENTION

Fuel injection technology is employed in most combustion systems, such as internal combustion engines or oil burners. It is well known that atomization plays an important role in combustion efficiency and pollutant emissions, specifically, that a finer fuel mist allows a more efficient burn of the fuel, resulting in more power output and fewer harmful emissions. This is attributed to a fact that combustion starts from the interface between the fuel and air (oxygen). If the size of the fuel droplets is reduced, the total surface area to start burning process increases, boosting combustion efficiency, and improving emissions.

One method of reducing the size of fuel droplets is to provide a fuel injector that utilizes a high pressure, such as up to 200 bar (20,000 KPa) for gasoline, to reduce the size of fuel droplets to 25 μm in diameter. Such an injector, however, would require substantial changes to the fuel lines in vehicles, as the current gasoline fuel lines can only sustain a fuel pressure less than 3 bar (300 KPa).

Another known method of reducing the size of fuel droplets is electrostatic atomization, which makes all fuel droplets negatively charged. The droplet size is small if the charge density on the droplets is high. In addition, since the negatively charged droplets are repulsive to each other, no agglomeration will occur. Present electrostatic atomization technology requires special fuel injectors with a very high voltage directly applied to the nozzle of each injector. The emitter cathode emits negative charges to pass the fuel to the anode, and does not move down to close the nozzle in order to stop the spray. The use of such an injector requires substantial modifications to existing vehicle fuel systems.

There exists a need to provide a method of generating a finer fuel mist from a fuel injector than is presently generated, resulting in cleaner combustion, higher power output, and higher fuel efficiency.

SUMMARY OF THE INVENTION

Briefly, the present invention provides a method of reducing the size of fuel particles injected by an injector. The method comprises the steps of providing a flow of fuel through a fuel line; subjecting the fluid to an electrical field sufficient to lower the viscosity of the fluid from transmittal from the fuel line to the injector; transmitting the fluid from the fuel line to the injector; and injecting the fluid from the injector.

The present invention also provides an apparatus for reducing the size of fuel particles injected into a combustion chamber. The apparatus comprises a fuel line, a first metallic mesh disposed within the fuel line, and a second metallic mesh disposed within the fuel line, upstream or downstream of the first metallic mesh. An electrical supply is electrically coupled to the first metallic mesh and the second metallic mesh. Operation of the electrical supply generates an electrical field between the first metallic mesh and the second metallic mesh. A fuel injector is disposed at an end of the fuel line, downstream from the metallic mesh.

Further, the present invention provides a method of improving gas mileage in a vehicle, a method of increasing power output from a combustion engine, and a method of improving emissions from a combustion engine by flowing fuel through a fuel line; applying an electrical field to the fuel within the fuel line in a direction parallel to the direction of fuel flow to reduce viscosity thereof; and discharging the fuel having reduced viscosity through a fuel injector into a combustion chamber for combustion.

In another aspect, the present invention provides a method of increasing power output from a combustion engine comprising flowing fuel through a fuel line; applying an electrical field to the fuel within the fuel line to reduce the viscosity thereof; and discharging the fuel having reduced viscosity through a fuel injector into a combustion chamber for combustion.

In yet another aspect, the present invention provides a method of improving emissions from a combustion engine comprising flowing fuel through a fuel line; applying an electric field to the fuel within the fuel line to reduce the viscosity thereof; and discharging the fuel having reduced viscosity through a fuel injector into a combustion chamber for combustion.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention. In the drawings.

DETAILED DESCRIPTION OF THE INVENTION

Certain terminology is used in the following description for convenience only and is not limiting. The terminology includes the words above specifically mentioned, derivatives thereof and words of similar import. The embodiment illustrated below is not intended to be exhaustive or to limit the invention to the precise form disclosed. This embodiment is chosen and described to best explain the principle of the invention and its application and practical use and to enable others skilled in the art to best utilize the invention.

The present invention is used to reduce the viscosity of fuel as the fuel passes through an electric field inside a fuel line prior to entering a fuel injector for injection into a combustion chamber. When the viscosity of the fuel is reduced, the size of the ejected sprayed fuel droplets is reduced as well, resulting in more efficient combustion of the fuel. The invention has application in vehicles with combustion engines, such as automobiles, airplanes, and ships, as well as non-vehicular applications, such as generators. While the present invention is directed to decreasing the size of fuel droplets ejected from a fuel injector, those skilled in the art will recognize that the present invention is not limited to fuel as the fluid, but may be used on other fluids as well in order to reduce the viscosity of the fluid and thus the particle size of sprayed droplets. For example, the technology embodied in the present invention may be used in other applications requiring small spray droplets, such as paint sprayers.

Figure 1:
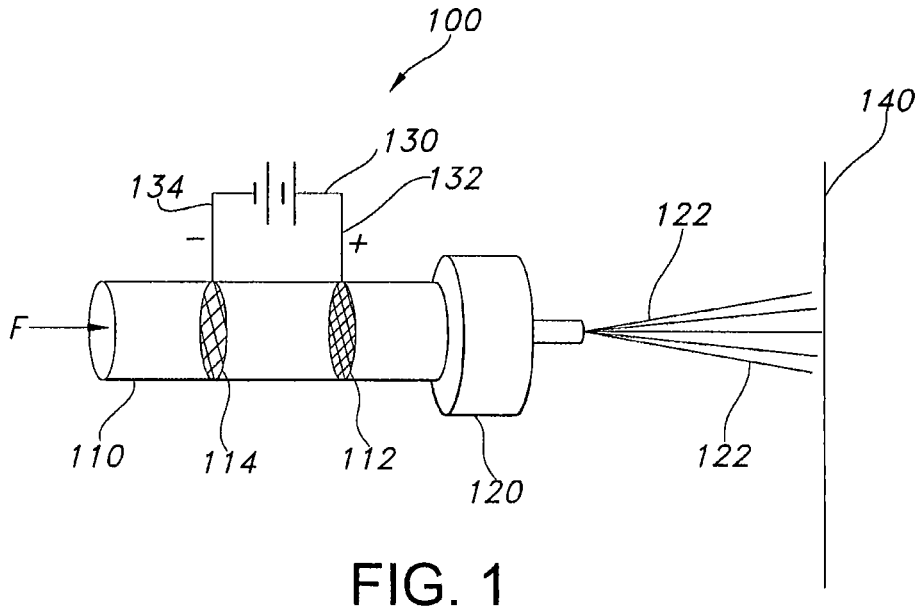
FIG. 1 is a schematic drawing of a test set-up using an electric-field assisted fuel injector system according to an exemplary embodiment of the present invention.

An electric-field assisted fuel injection system 100 according to an exemplary embodiment of the present invention is schematically shown in FIG. 1. Injection system 100 includes a fuel line 110 through which fuel "F" flows. As shown in FIG. 1, fuel F flows from left (upstream side) to right (downstream side). Fuel F flows from fuel line 110 to a fuel injector 120, which injects fuel F into a combustion chamber (not shown) for combustion.

A downstream mesh 112 is inserted into fuel line 110. An upstream mesh 114, is also inserted into fuel line 110, upstream from downstream mesh 112. Meshes 112, 114 are electrically insulated from any other metal, including fuel line 110, and form a capacitor within fuel line 110. Upstream mesh 114 may desirably be located between approximately 0.5 and 2 centimeters from downstream mesh 112. Further, downstream mesh 112 may desirably be located approximately 10-30 centimeters from fuel injector 120. Meshes 112, 114 may be constructed from copper or some other electrically conductive metal. Desirably, the electrically conductive metal from which meshes 112, 114 are constructed does not chemically react with the fuel F that is flowing the fuel line 110 and past meshes 112, 114. Meshes 112, 114 have a sufficiently coarse mesh size so as not to adversely impact flow of fuel F through fuel line 110 into fuel injector 120.

A voltage supply 130 is electrically coupled to each of the downstream mesh 112 and the upstream mesh 114 in order to generate an electrical field between downstream mesh 112 and upstream mesh 114. A positive terminal 132 of electrical supply 130 is coupled to downstream mesh 112, making downstream mesh 112 an anode, and a negative terminal 134 of electrical supply 130 is coupled to upstream mesh 114, making upstream mesh 114 a cathode. Such an arrangement generates an electrical field in a direction parallel to but opposite the direction of fuel flow F. The diameter and mesh size of meshes 112, 114 may be adjusted according to the fuel flow rate.

In another embodiment (not shown), the electric field is generated by a capacitor across which the electric field is applied in a direction other than the direction of the flow fuel F. It is contemplated that the electric field can be applied in almost any feasible direction across the flow and still achieve a reduction in viscosity.

Voltage supply 130 may be a direct current (DC) power source, although an alternating current (AC) power source that generates an electric field having a low frequency may be used. When applying an AC electric field, the frequency of the applied field is in the range of about 1 to about 3000 Hz, for example from about 25 Hz to about 1500 Hz. This field can be applied in a direction parallel to the direction of the flow of the fluid or it can be applied in a direction other than the direction of the flow of the fluid.

Voltage supply 130 is strong enough to generate an electrical field of between approximately 100 V/mm and 2500 V/mm between meshes 112, 114. The selection of a particular value within this range is expected to depend on the composition of the fluid, the desired degree of reduction in viscosity, the temperature of the fluid, and the period during which the field is to be applied. It will be appreciated that if the field strength is too low or the application period too short no significant change in viscosity will result. Conversely, if the strength of the electric field is too high or the period of application too long, the viscosity of the fluid may actually increase.

Because of the small amount of fuel F that is consumed in each injection cycle of fuel injector 120, the time lapse for fuel F to travel between meshes 112, 114 may be as great as 120 seconds. One factor that impacts this travel time is rate of consumption of fuel F. For example, acceleration of a vehicle (not shown) in which injection system 100 is used will consume fuel F faster than idling of the same vehicle. Consequently, fuel F will be affected by the electrical field generated between meshes 112, 114 for less time during acceleration than idling. With due consideration to these factors, residence time of the fuel as fluid within the electric field may vary, for example, between 0.1 and 120 seconds.

Figure 4:
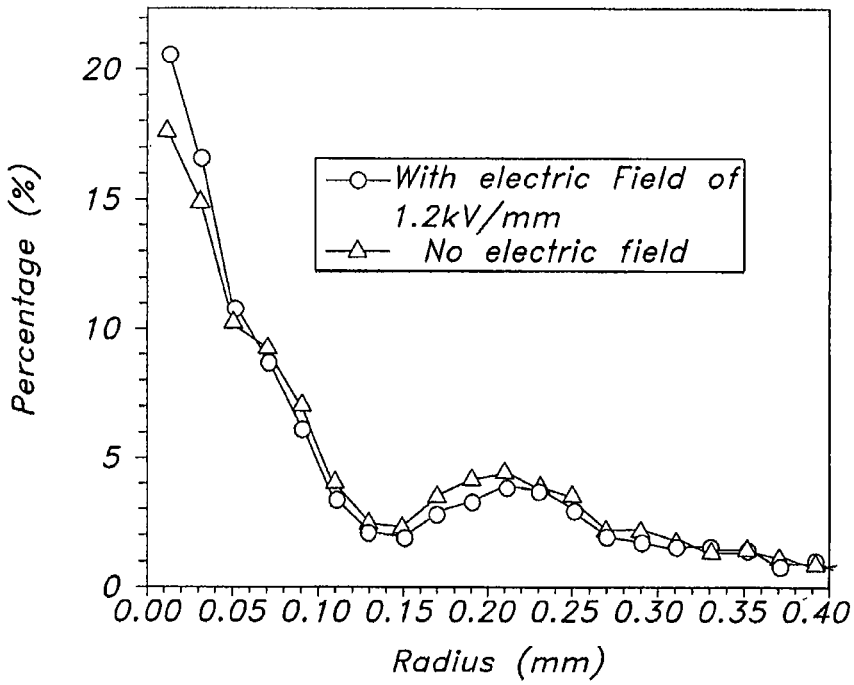
FIG. 4 is a graph showing size of droplets of gasoline mixed with 20% ethanol after passing through the electric-field assisted fuel injector system versus percentage of total droplets.
Figure 5:
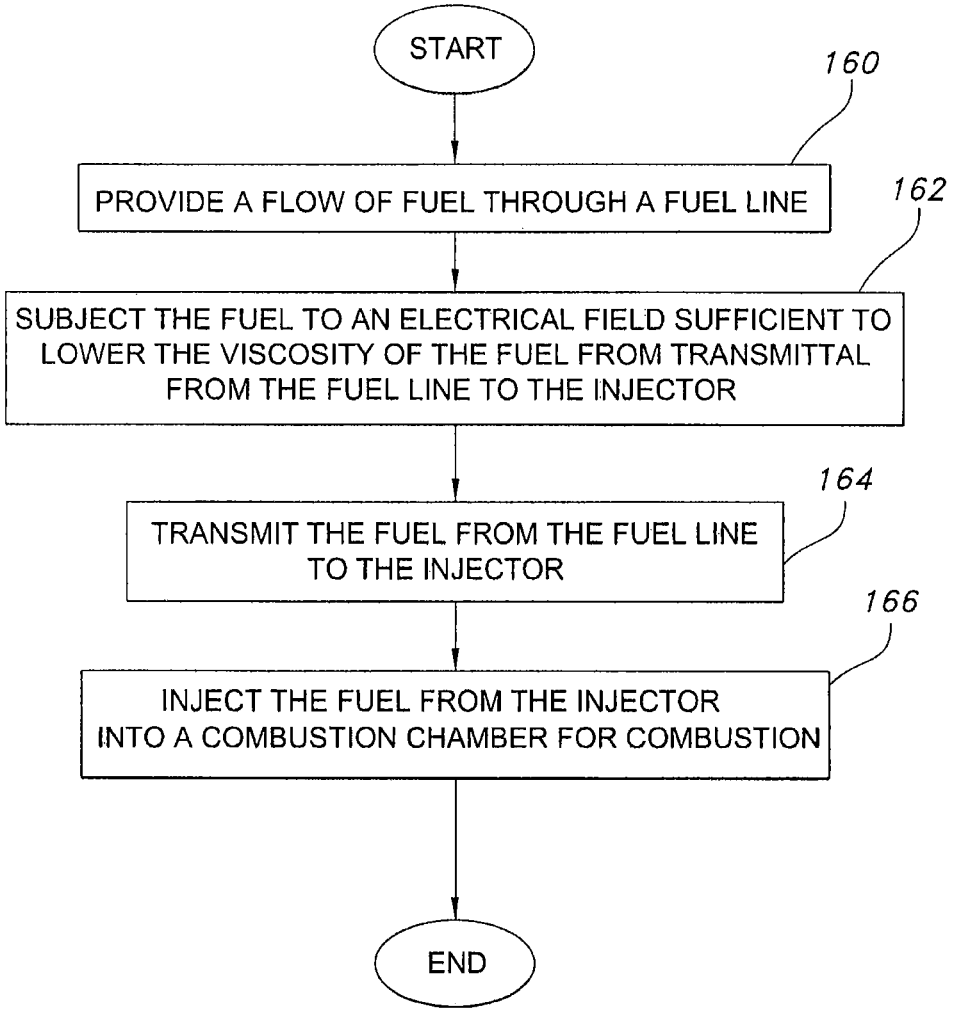
FIG. 5 is a flowchart showing the method of using the system shown in FIG. 1.

The flowchart of FIG. 4 illustrates a method of using system 100. In step 160, a flow of fuel F is provided through fuel line 110. In step 162, fuel F is subjected to an electrical field sufficient to lower the viscosity of fuel F from transmittal from fuel line 110 to injector 120. The electrical field travels in a direction parallel to, but opposite of the flow of fuel F. In step 164, Fuel F is transmitted from fuel line 110 to injector 120. In step 166, fuel F is injected from injector 120 into a combustion chamber for combustion. System 100 can be used to reduce the size of fuel particles, improve gas mileage in a vehicle, increase power output from a combustion engine, and improve emissions from a combustion engine.

EXAMPLES

An experimental setup using injection system 100 is shown in FIG. 1. Fuel injector 120 that was used in the experiment was an Accel™ high impedance fuel injector, manufactured by manufactured by Mr. Gasket Co. in Cleveland, Ohio.

Figure 2:
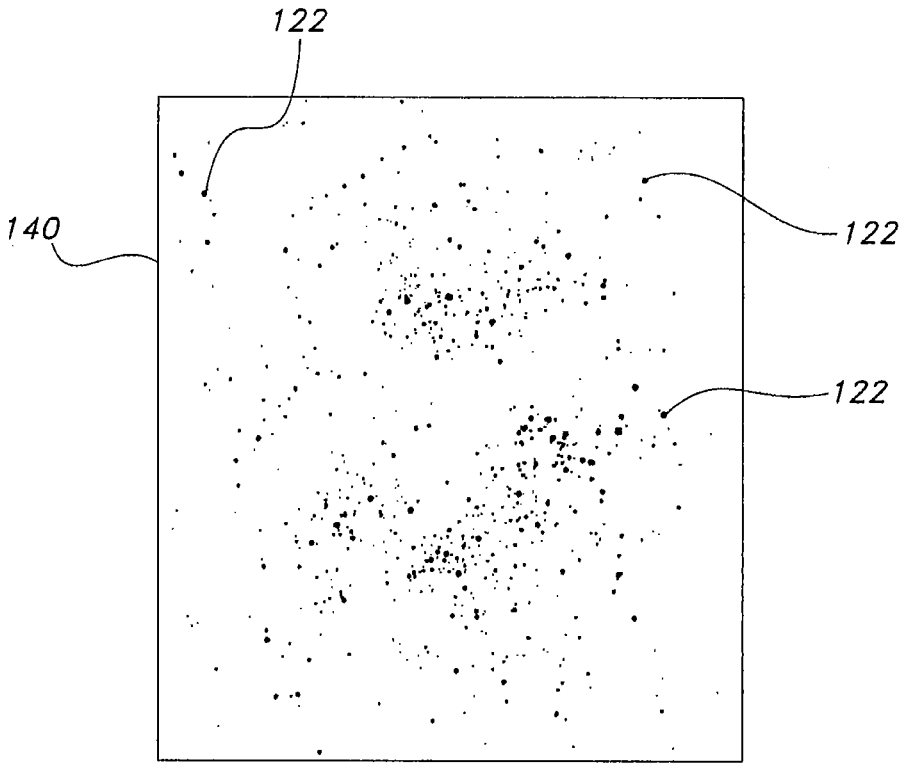
FIG. 2 is a spray pattern of fuel droplets onto a plate using the injector system of FIG. 1.

In the experiment, fuel F took approximately 15 seconds to pass the electric field generated between meshes 112, 114. Each fuel spray from fuel injector 120 lasted for about 4 milliseconds, generating fuel droplets 122 from fuel injector 120. Droplets 122 were collected by a plate 140, which was covered with a layer of oxidized magnesium. Plate 140 is square, approximately 10 centimeters×10 centimeters, which is large enough to collect all droplets 122 in the spray. Plate 140 was located approximately 10 centimeters from discharge of fuel injector 120. An exemplary recording of collected droplets 122 is shown in FIG. 2.

Once droplets 122 were collected, plate 140 was scanned by a high resolution scanner (not shown) and the droplet size distributions were then analyzed by imaging software. While this method is slower and more time consuming than known optical scattering techniques, it is believed that this method is more reliable than any other methods. Every droplet 122 in the spray was recorded and physically measured.

Figure 3:
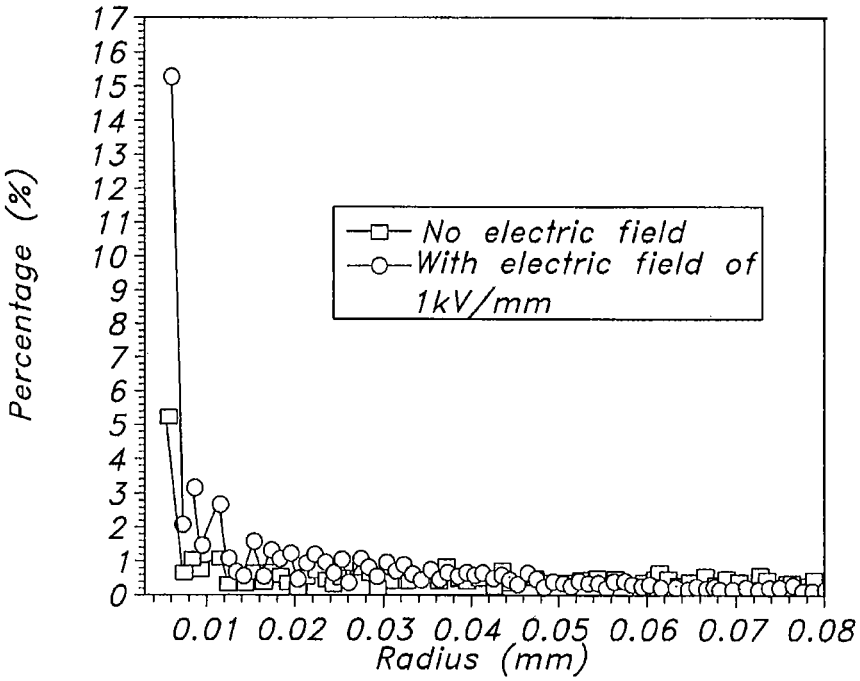
FIG. 3 is a graph showing size of droplets of diesel fuel after passing through the electric-field assisted fuel injector system versus percentage of total droplets.

Fuel F that was tested in accordance with this test set-up was diesel fuel, as well as gasoline with 20% ethanol. Tests were conducted with injection system 100 s not in use, to set a baseline, and then with injection system 100 in use, to determine the benefits over the baseline results. Statistical results for the diesel fuel are shown in FIG. 3, while the results for gasoline with 20% ethanol are shown in FIG. 4. The results are averaged over numerous tests. It is clear from both figures that a strong electric field reduces the size of the droplets 122 in the atomization process.

Example 1

For the experiment with diesel fuel, the fuel pressure was 200 psi (about 1,380 KPa), the electric field was about 1.0 kV/mm. The fuel F took about 15 seconds to pass the electric field. The effect on diesel fuel is very significant. For example, the number of droplets 122 of radius below 5 μm was increased from 5.3% (baseline) to 15.3%, an increase of a factor of three. It is also clear from FIG. 3 that the electric field made most of droplets 122 to have radius below 40 μm. If injection system 100 is applied on a diesel vehicle, it is estimated that fuel mileage will be increased by 15-30% and that emission will also be greatly improved.

Example 2

In the experiment with gasoline (with 20% ethanol), the fuel pressure was 110 psi (about 760 KPa), the electric field was 1.2 kV/mm, and the fuel F took about 15 seconds to pass the electric field. The effect on gasoline is also significant. For example, the number of droplets 122 with radius of 10 μm was increased from 17.6% (baseline) to 20.7%, an increase of 20%. If injection system 100 is applied on a gasoline powered vehicle, it is estimated that the gas mileage will be increased by 5-10% and that emission will also be greatly improved.

Example 3

Figure 6:
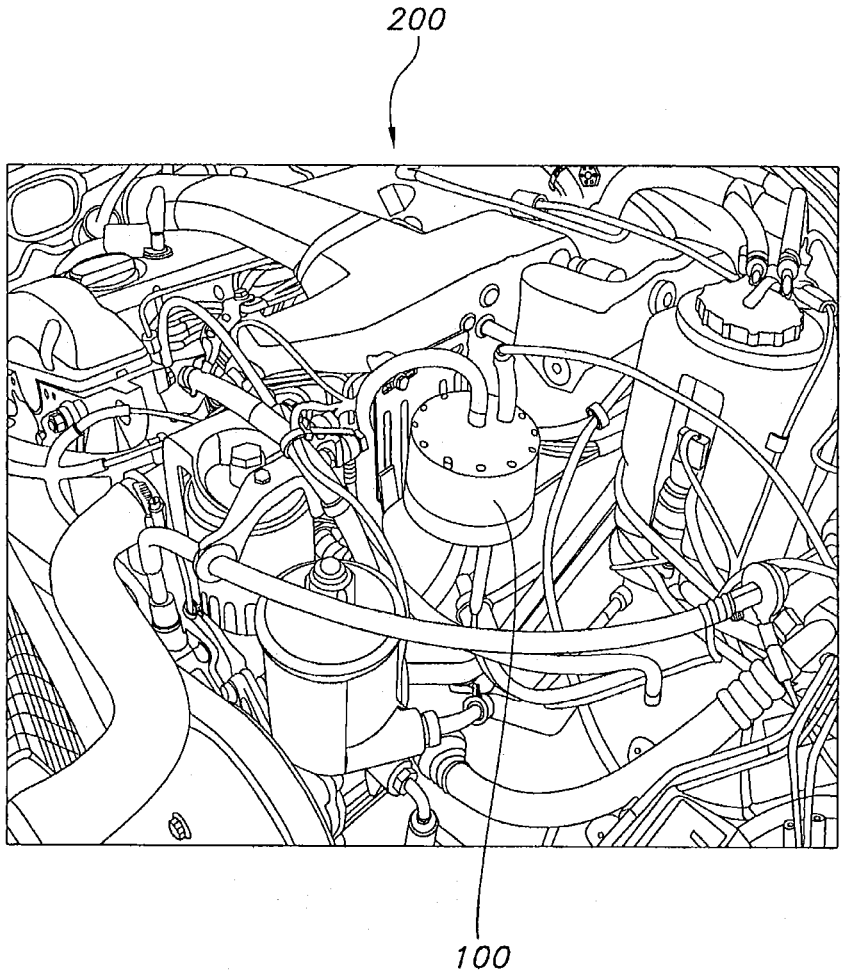
FIG. 6 is a perspective view of a vehicle fuel system showing an exemplary embodiment of the electric-field assisted fuel injection system installed in the vehicle fuel system.

Road tests were conducted using injection system 100 in the fuel system of a Mercedes Benz 300D vehicle 200, as shown in FIG. 6. System 100 is installed in vehicle 200 such that fuel flows through system 100 vertically, from the bottom up to the top of system 100.

Using system 100 increased the gas mileage of the vehicle from approximately 30 miles per gallon (approximately 12.75 kilometers per liter) without using system 100 to approximately 36 miles per gallon (approximately 15.3 kilometers per liter) using system 100, an increase of approximately 20%. In this example, the electric field strength was between about 800 V/mm and about 1500 V/mm, with the fuel flow time between meshes 114, 112 being about 5 seconds.

Additionally, it is believed that, for both diesel and gasoline fuels, injection system 100 yields higher horsepower output per unit of fuel as a result of the smaller size of droplets 122 due to the lower viscosity of fuel F being injected for combustion.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method of reducing the size of fuel particles injected from an injector comprising the steps of:

a) providing a flow of fuel through a fuel line;

b) subjecting the fuel to an electrical field sufficient to lower the viscosity of the fuel from transmittal from the fuel line to the injector, the electrical field having a strength less than about 1500 V/mm;

c) transmitting the fuel from the fuel line to the injector; and d) injecting the fuel from the injector.

2. The method according to claim 1, wherein steps a) and b) comprise providing the flow of fuel in a direction parallel to the direction of the electric field.

3. The method according to claim 2, wherein steps a) and b) comprise providing the flow of fuel in a direction opposite the direction of the electric field.

4. The method according to step 1, wherein step b) comprises subjecting the fluid to the electrical field between about 5 seconds to about 15 seconds.

5. An apparatus for reducing the size of fuel particles injected into a combustion chamber comprising:

a fuel line;

a first metallic mesh disposed within the fuel line;

a second metallic mesh disposed within the fuel line, upstream of the first metallic mesh; and an electrical supply electrically coupled to the first metallic mesh and the second metallic mesh, wherein operation of the electrical supply generates an electrical field between the first metallic mesh and the second metallic mesh, the electrical field having a strength less than about 1500 V/mm; and a fuel injector disposed at an end of the fuel line, downstream from the first metallic mesh.

6. The apparatus according to claim 5, wherein the electrical source comprises a direct current source.

7. The apparatus according to claim 5, wherein the first metallic mesh comprises an anode.

8. The apparatus according to claim 5, wherein the first metallic mesh is spaced from the second metallic mesh a distance sufficient to require between about 5 seconds and about 15 seconds for fuel in the fuel line to travel between the first mesh and the second mesh.

9. A method of improving gas mileage in vehicle comprising:

flowing fuel through a fuel line;

applying an electrical field to the fuel within the fuel line to reduce viscosity thereof, the electrical field having a strength less than about 1500 V/mm; and discharging the fuel having reduced viscosity through a fuel injector into a combustion chamber for combustion.

10. A method of increasing power output from a combustion engine comprising:

flowing fuel through a fuel line;

applying an electrical field to the fuel within the fuel line to reduce viscosity thereof, the electrical field having a strength less than about 1500 V/mm; and discharging the fuel having reduced viscosity through a fuel injector into a combustion chamber for combustion.

11. A method of improving emissions from a combustion engine comprising:

flowing fuel through a fuel line;

applying an electrical field to the fuel within the fuel line to reduce viscosity thereof the electrical field having a strength less than about 1500 V/mm; and discharging the fuel having reduced viscosity through a fuel injector into a combustion chamber for combustion.

* * * * *